US006089366A

United States Patent [19]

Cheng

[11] Patent Number: 6,089,366

[45] Date of Patent: Jul. 18, 2000

[54] BOTTLE BOX

[76] Inventor: Jackson Cheng, 58, Ma Yuan West St., Taichung, Taiwan

[21] Appl. No.: 09/400,991

[22] Filed: Sep. 21, 1999

[51] Int. Cl.[7] ..... B65B 21/00

[52] U.S. Cl. ..... 206/192; 206/199; 220/4.21

[58] Field of Search ..... 206/158, 144, 206/192, 199; 220/4.21; 24/625, 704.1

[56] References Cited

U.S. PATENT DOCUMENTS

| | | | |
|---|---|---|---|
| 5,069,335 | 12/1991 | Beales | 206/144 |
| 5,651,651 | 7/1997 | Spencer | 411/372.6 |
| 6,010,023 | 1/2000 | Besserer | 220/4.21 |

FOREIGN PATENT DOCUMENTS

| | | | |
|---|---|---|---|
| 1122172 | 9/1956 | France | 24/625 |
| 1063361 | 8/1959 | Germany | 24/704.1 |

*Primary Examiner*—Paul T. Sewell
*Assistant Examiner*—Troy Arnold

[57] ABSTRACT

A bottle box has two half-casings engaging with each other. Both half-casings are made of plastics. Each half-casing has a hollow seat and a handle frame disposed on the hollow seat. The hollow seat has a hollow interior, a periphery flange, and a plurality of slots communicating with the hollow interior. A reinforced plate is disposed in a bottom of the hollow seat. The periphery flange has a click block, a click recess, a protrusion, a recess hole, at least a protruded block, and at least a click groove. The protruded block has a click hook. A flap bar is disposed in the click groove. The block has a hook end. A flap plate is disposed in the click recess.

3 Claims, 4 Drawing Sheets

BOTTLE BOX

BACKGROUND OF THE INVENTION

The present invention relates to a bottle box. More particularly, the present invention relates to a bottle box which is assembled easily.

Referring to FIG. 1, a conventional bottle box can receive a plurality of bottles. The conventional bottle box comprises two half-casings 10. The half-casings 10 are made of plastics. Each of the half-casings 10 has a hollow seat 11 and a handle frame 12 disposed on the hollow seat 11. The hollow seat 11 has a hollow interior 111, a periphery flange 113, and a plurality of slots 112 communicating with the hollow interior 111. The periphery flange 113 has a face 110 and a plurality of through holes 13. Each of the through holes 13 receives a metal bolt 2. Since the metal bolt 2 should be fastened manually, it will consumes many man powers. Furthermore, the metal bolt 2 is made of metal so that the metal bolt 2 should be detached before the conventional bottle box is recycled.

SUMMARY OF THE INVENTION

An object of the present invention is to provide a bottle box which is assembled easily.

Accordingly, a bottle box of the present invention comprises a first half-casing and a second half-casing engaging with the first half-casing. The first half-casing and the second half-casing are made of plastics. The first half-casings has a first hollow seat and a first handle frame disposed on the first hollow seat. The first hollow seat has a first hollow interior, a first periphery flange, and a plurality of first slots communicating with the first hollow interior. A first reinforced plate is disposed in a bottom of the first hollow seat. The first periphery flange has a first click block, a first click recess, a first protrusion, a first recess hole, at least a first protruded block, and at least a first click groove. The first protruded block has a first click hook. A first flap bar is disposed in the first click groove. The first click block has a first hook end. A first flap plate is disposed in the first click recess. The second half-casings has a second hollow seat and a second handle frame disposed on the second hollow seat. The second hollow seat has a second hollow interior, a second periphery flange, and a plurality of second slots communicating with the second hollow interior. A second reinforced plate is disposed in a bottom of the second hollow seat. The second periphery flange has a second click block, a second click recess, a second protrusion, a second recess hole, at least a second protruded block, and at least a second click groove. The second protruded block has a second click hook. A second flap bar is disposed in the second click groove. The second click block has a second hook end. A second flap plate is disposed in the second Slick recess. A plurality of second collars are disposed on the second hollow seat. Each of the second collars engages with a second hollow plug. The first click block is inserted in the second click recess. The first hook end of the first click block engages with the second flap plate of the second click recess. The first protrusion is inserted in the second recess hole. The first protruded block is inserted in the second click groove. The first click hook of the first protruded block engages with the second flap bar of the second click groove. The second click block is inserted in the first click recess. The second hook end of the second click block engages with the first flap plate of the first click recess. The second protrusion is inserted in the first recess hole. The second protruded block is inserted in the first click groove. The second click hook of the second protruded block engages with the first flap bar of the first click groove.

DETAILED DESCRIPTION OF THE INVENTION

Figure 1:
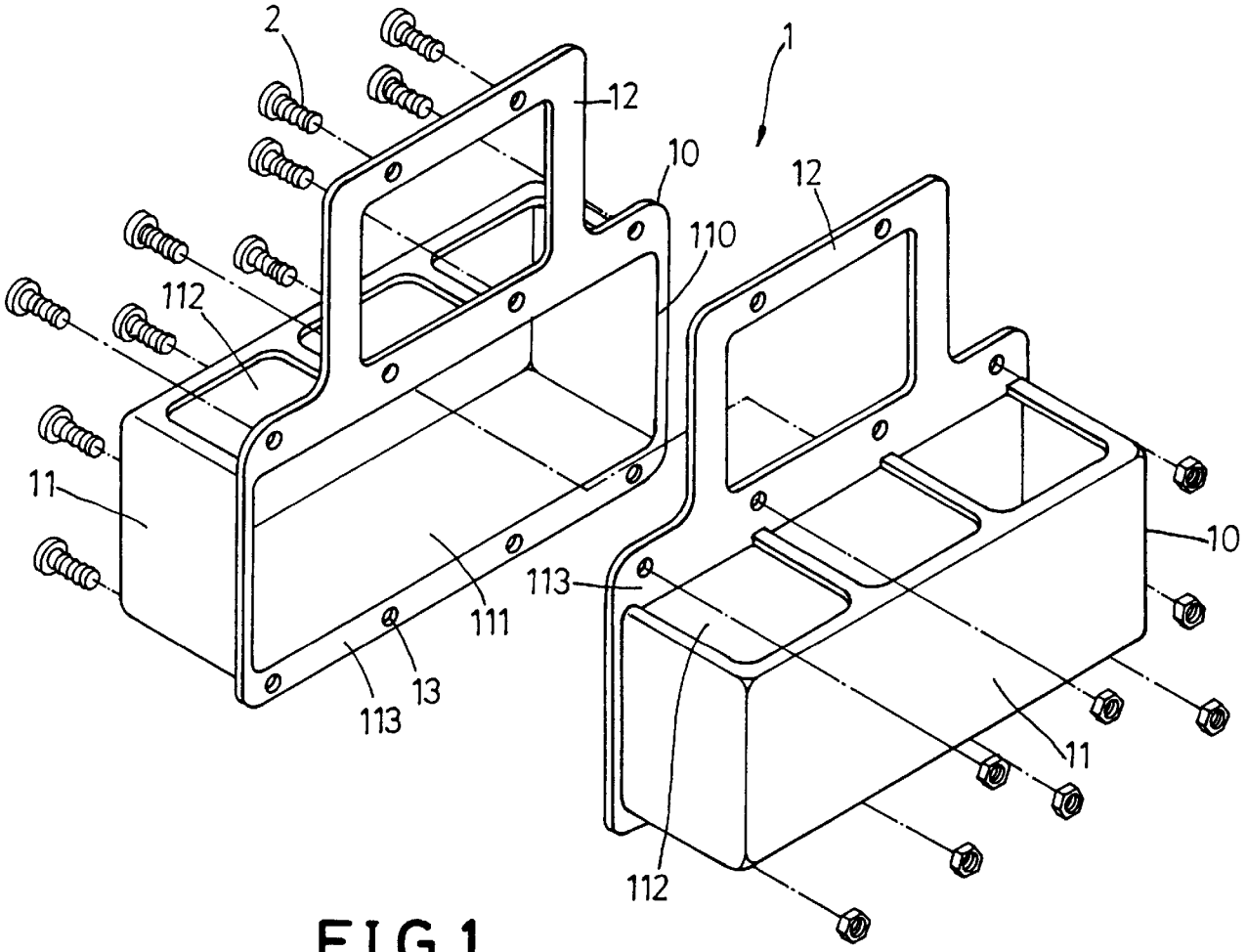
FIG.1 PRIOR ART
FIG. 1 is a perspective exploded view of a conventional bottle box of the prior art.
Figure 2:
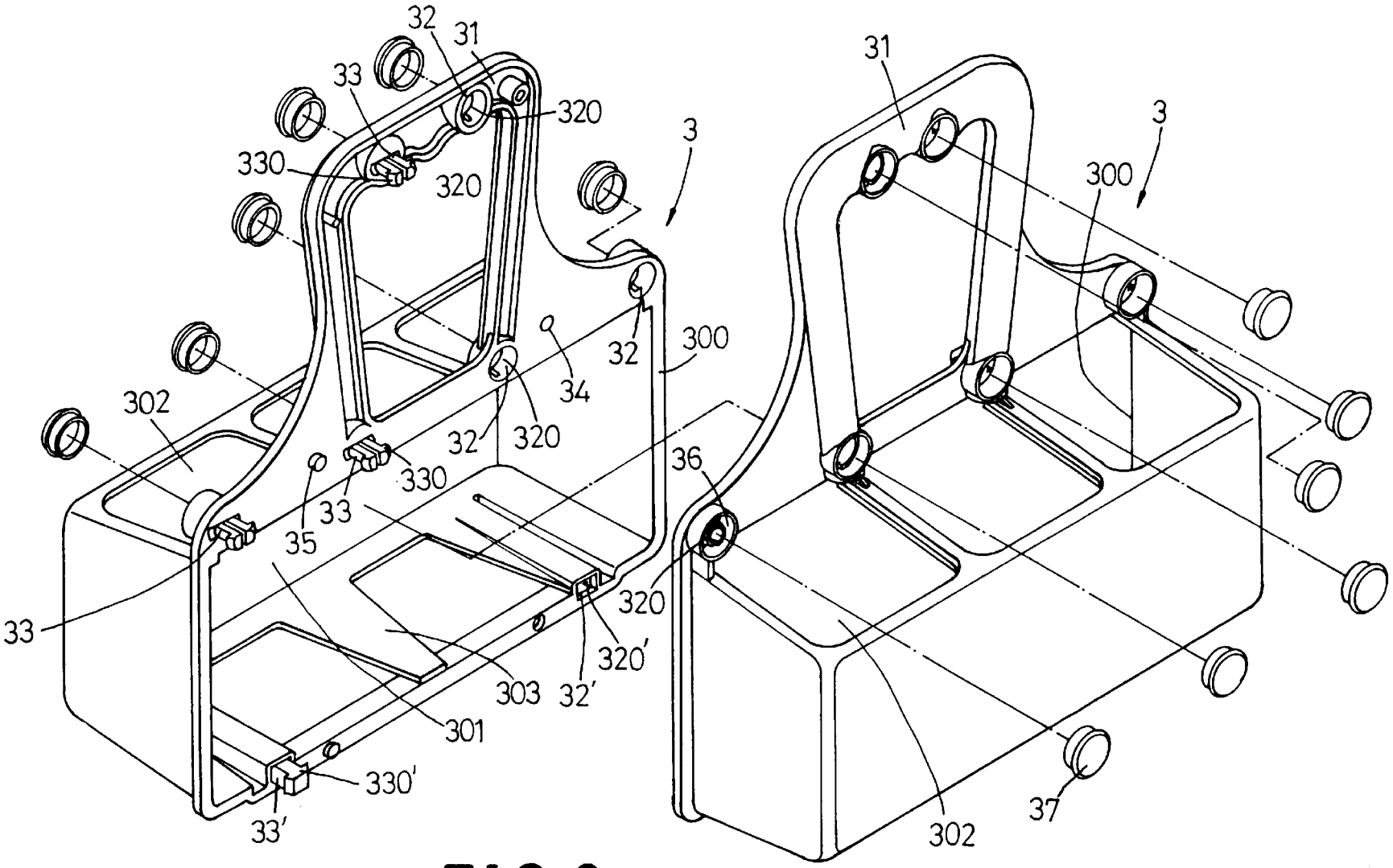
FIG. 2 is a perspective exploded view of a bottle box of a preferred embodiment in accordance with the present invention.
Figure 3:
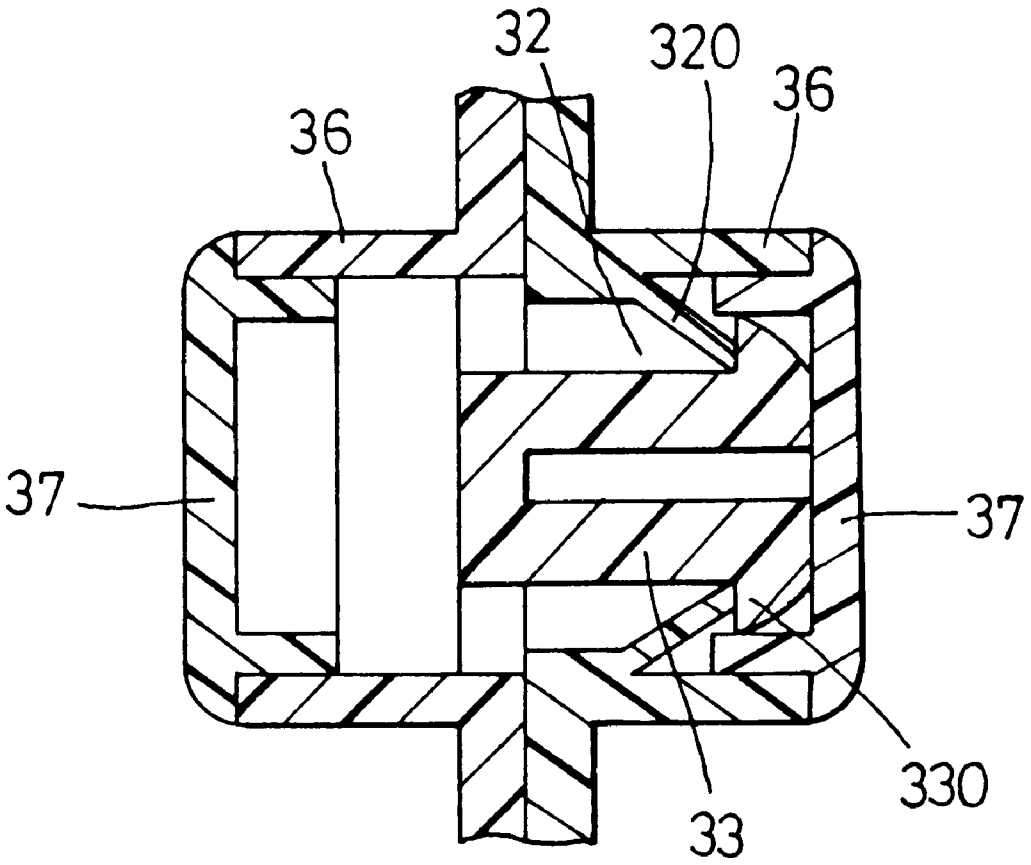
FIG. 3 is a partially sectional view of a bottle box of a preferred embodiment in accordance with the present invention.
Figure 4:
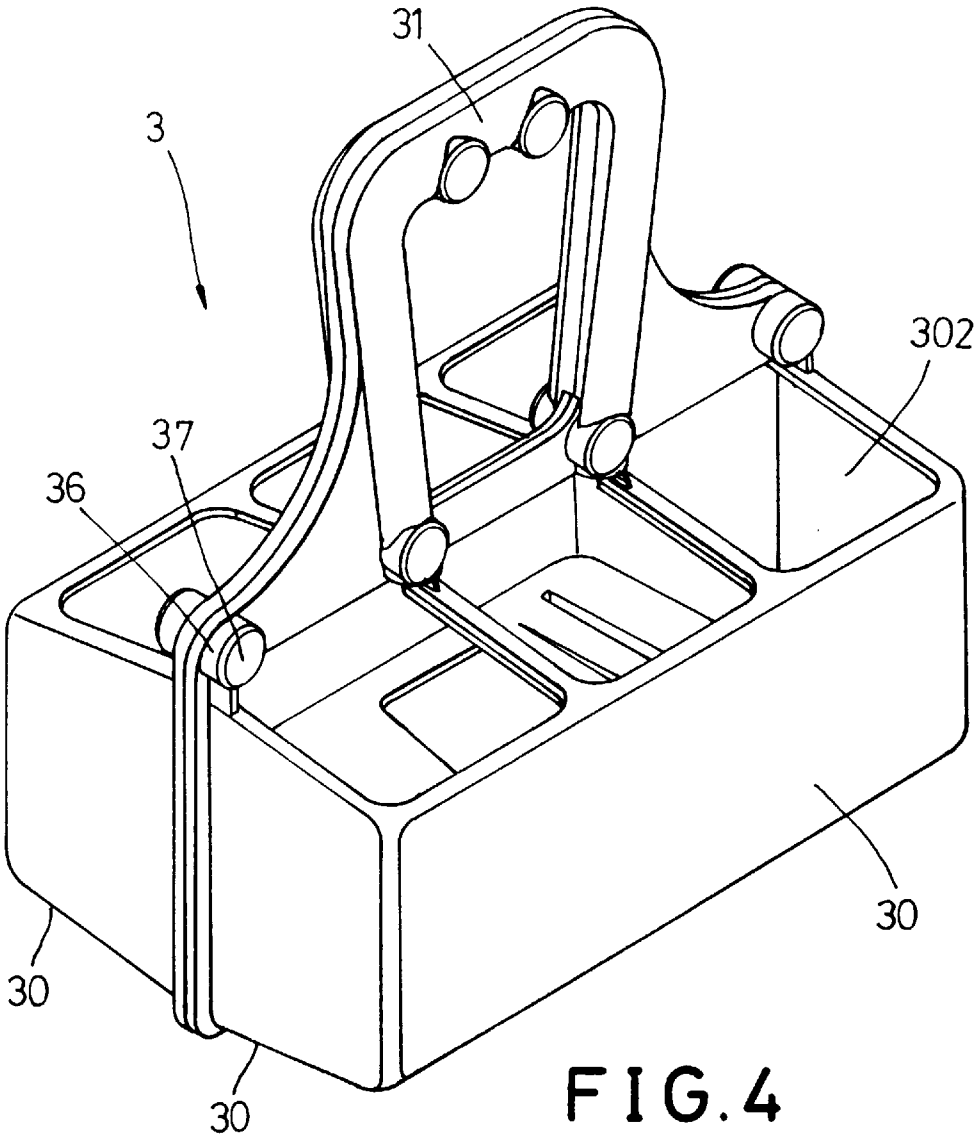
FIG. 4 is a perspective assembly view of a bottle box of a preferred embodiment in accordance with the present invention.

Referring to FIGS. 2 to 4, a bottle box comprises a first half-casing 3 and a second half-casing 3 engaging with the first half-casing 3. The first half-casing 3 and the second half-casing 3 are made of plastics.

The first half-casings 3 has a first hollow seat 30 and a first handle frame 31 disposed on the first hollow seat 30. The first hollow seat 30 has a first hollow interior 301, a first periphery flange 300, and a plurality of first slots 302 communicating with the first hollow interior 301.

A first reinforced plate 303 is disposed in a bottom of the first hollow seat 30.

The first periphery flange 300 has a first click block 33', a first click recess 32', a first protrusion 35, a first recess hole 34, at least a first protruded block 33, and at least a first click groove 32.

The first protruded block 33 has a first click hook 330. A first flap bar 320 is disposed in the first click groove 32.

The first click block 33' has a first hook end 330'. A first flap plate 320' is disposed in the first click recess 32'.

A plurality of first collars 36 are disposed on the first hollow seat 30. Each of the first collars 36 engages with a first hollow plug 37.

The second half-casings 3 has a second hollow seat 30 and a second handle frame 31 disposed on the second hollow seat 30. The second hollow seat 30 has a second hollow interior 301, a second periphery flange 300, and a plurality of second slots 302 communicating with the second hollow interior 301.

A second reinforced plate 303 is disposed in a bottom of the second hollow seat 30.

The second periphery flange 300 has a second click block 33', a second click recess 32', a second protrusion 35, a second recess hole 34, at least a second protruded block 33, and at least a second click groove 32.

The second protruded block 33 has a second click hook 330. A second flap bar 320 is disposed in the second click groove 32.

The second click block 33' has a second hook end 330'. A second flap plate 320' is disposed in the second click recess 32'.

A plurality of second collars 36 are disposed on the second hollow seat 30. Each of the second collars 36 engages with a second hollow plug 37.

The first click block 33' is inserted in the second click recess 32'.

The first hook end 330' of the first click block 33' engages with the second flap plate 320' of the second click recess 32'.

The first protrusion 35 is inserted in the second recess hole 34.

The first protruded block 33 is inserted in the second click groove 32. The first click hook 330 of the first protruded block 33 engages with the second flap bar 320 of the second click groove 32.

The second click block 33' is inserted in the first click recess 32'.

The second hook end 330' of the second click block 33' engages with the first flap plate 320' of the first click recess 32'.

The second protrusion 35 is inserted in the first recess hole 34.

The second protruded block 33 is inserted in the first click groove 32. The second click hook 330 of the second protruded block 33 engages with the first flap bar 320 of the first click groove 32.

The invention is not limited to the above embodiment but various modification thereof may be made. Further, various changes in form and detail may be made without departing from the scope of the invention.

I claim:

1. A bottle box comprises:

a first half-casing and a second half-casing engaging with the first half-casing, the first half-casing and the second half-casing made of plastics, the first half-casings having a first hollow seat and a first handle frame disposed on the first hollow seat, the first hollow seat having a first hollow interior, a first periphery flange, and a plurality of first slots communicating with the first hollow interior, a first reinforced plate disposed in a bottom of the first hollow seat, the first periphery flange having a first click block, a first click recess, a first protrusion, a first recess hole, at least a first protruded block, and at least a first click groove, the first protruded block having a first click hook, a first flap bar disposed in the first click groove, the first click block having a first hook end, a first flap plate disposed in the first click recess, the second half-casings having a second hollow seat and a second handle frame disposed on the second hollow seat, the second hollow seat having a second hollow interior, a second periphery flange, and a plurality of second slots communicating with the second hollow interior, a second reinforced plate disposed in a bottom of the second hollow seat, the second periphery flange having a second click block, a second click recess, a second protrusion, a second recess hole, at least a second protruded block, and at least a second click groove, the second protruded block having a second click hook, a second flap bar disposed in the second click groove, the second click block having a second hook end, a second flap plate disposed in the second click recess, a plurality of second collars disposed on the second hollow seat, each of the second collars engaging with a second hollow plug, the first click block inserted in the second click recess, the first hook end of the first click block engaging with the second flap plate of the second click recess, the first protrusion inserted in the second recess hole, the first protruded block inserted in the second click groove, the first click hook of the first protruded block engaging with the second flap bar of the second click groove, the second click block inserted in the first click recess, the second hook end of the second click block engaging with the first flap plate of the first click recess, the second protrusion inserted in the first recess hole, the second protruded block inserted in the first click groove, and the second click hook of the second protruded block engaging with the first flap bar of the first click groove.

2. The bottle box as claimed in claim 1, wherein a plurality of first collars are disposed on the first hollow seat, and each of the first collars engages with a first hollow plug.

3. The bottle box as claimed in claim 1, wherein a plurality of second collars are disposed on the second hollow seat, and each of the second collars engages with a second hollow plug.

* * * * *